US008836456B2

(12) United States Patent
Tachikawa et al.

(10) Patent No.: US 8,836,456 B2
(45) Date of Patent: Sep. 16, 2014

(54) ELECTROMAGNETIC CONTACTOR

(75) Inventors: Hiroyuki Tachikawa, Yokohama (JP); Masaru Isozaki, Ichihara (JP); Osamu Kashimura, Hino (JP); Kouetsu Takaya, Kounosu (JP); Yasuhiro Naka, Kounosu (JP); Yuji Shiba, Kounosu (JP)

(73) Assignees: Fuji Electric Co., Ltd., Kawasaki-shi (JP); Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/878,945

(22) PCT Filed: May 9, 2012

(86) PCT No.: PCT/JP2012/003042

§ 371 (c)(1),
(2), (4) Date: May 7, 2013

(87) PCT Pub. No.: WO2012/157217

PCT Pub. Date: Nov. 22, 2012

(65) Prior Publication Data

US 2013/0229247 A1 Sep. 5, 2013

(30) Foreign Application Priority Data

May 19, 2011 (JP) ..... 2011-112915

(51) Int. Cl.

| | |
|---|---|
| ***H01H 1/00*** | (2006.01) |
| ***H01H 9/34*** | (2006.01) |
| ***H01H 1/06*** | (2006.01) |
| ***H01H 50/54*** | (2006.01) |
| ***H01H 51/06*** | (2006.01) |
| *H01H 9/44* | (2006.01) |

(52) U.S. Cl.

CPC . *H01H 1/06* (2013.01); *H01H 9/34* (2013.01); *H01H 50/546* (2013.01); *H01H 51/065* (2013.01); *H01H 9/443* (2013.01)

USPC ..... 335/196; 335/132

(58) Field of Classification Search

USPC ..... 335/78, 106, 128, 132, 196–198

See application file for complete search history.

(56) References Cited

U.S. PATENT DOCUMENTS

| | | | | |
|---|---|---|---|---|
| 6,700,466 | B1 * | 3/2004 | Yamamoto et al. | 335/132 |
| 8,390,410 | B2 * | 3/2013 | Kojima et al. | 335/201 |
| 2004/0080389 | A1 * | 4/2004 | Nishida et al. | 335/132 |
| 2009/0237191 | A1 * | 9/2009 | Yano et al. | 335/202 |
| 2009/0322454 | A1 | 12/2009 | Hiroyasu et al. | |

FOREIGN PATENT DOCUMENTS

| | | | |
|---|---|---|---|
| JP | S59-144851 | U | 9/1984 |
| JP | S60-41724 | A | 3/1985 |
| JP | H07-065683 | A | 3/1995 |
| JP | H07-254338 | A | 10/1995 |
| JP | 2010-010056 | A | 1/2010 |
| JP | 2010-257789 | A | 11/2010 |

* cited by examiner

*Primary Examiner* — Bernard Rojas

(74) *Attorney, Agent, or Firm* — Manabu Kanesaka

(57) ABSTRACT

An electromagnetic contactor has a contact device including a pair of fixed contacts disposed to maintain a predetermined distance and a movable contact disposed to be capable of contacting to and separating from the pair of fixed contacts. An insulating cover covering all except a contact portion contacting with the movable contact is mounted on the pair of fixed contacts.

10 Claims, 11 Drawing Sheets

ELECTROMAGNETIC CONTACTOR

RELATED APPLICATIONS

The present application is National Phase of International Application No. PCT/JP2012/003042 filed May 9, 2012, and claims priority from Japanese Application No. 2011-112915, filed May 19, 2011.

TECHNICAL FIELD

The present invention relates to an electromagnetic contactor having a pair of fixed contacts disposed maintaining a predetermined interval and a movable contact disposed so as to be capable of contacting to and separating from the fixed contacts.

BACKGROUND ART

As an electromagnetic contactor that carries out switching of a current path, there is proposed an electromagnetic contactor, for example, comprising connection pieces disposed on an upper surface of a housing and capable of contacting with a printed substrate, contact pieces having a fixed contact housed in the housing so as to face the connection pieces, and a plurality of terminal plates having about C-shape and disposed on side surfaces of the housing, the terminal plate linking the connection piece and contact piece and being disposed to oppose to be separated by a predetermined distance, wherein a movable contact formed in a movable frame stored in the housing contacts with the fixed contacts of the opposing contact pieces (for example, refer to PTL 1).

CITATION LIST

Patent Literature

PTL 1: Japanese Patent Publication No. H7-65683

SUMMARY OF INVENTION

Technical Problem

Note that the heretofore known example described in PTL 1 is such that, as there is a distance between the fixed contact formed on the contact piece and the link piece, an arc generated between the movable contact and fixed contact when the two are separated after contacting the movable contact with the fixed contact does not affect the link piece. However, in an engaged condition wherein the movable contact is in contact with the fixed contact and current flows, an electromagnetic repulsion force is generated in the movable contact and fixed contact portions in a direction such as to cause the contacts to open when the current flowing is large, and it may no longer be possible to ensure stable contact between the movable contact and fixed contact.

Because of this, disposing the link piece in the vicinity of the fixed contact of the contact piece is being considered, thereby generating Lorentz force that opposes the electromagnetic repulsion force, and ensuring a stable engaged condition.

However, when bringing the link piece near the vicinity of the fixed contact of the contact piece in order to generate Lorentz force that opposes the electromagnetic repulsion force, an arc extinguishing permanent magnet is disposed in order to extinguish an arc generated between the movable contact and fixed contact when changing from the engaged condition to a released condition, the arc is extended by a magnetic field generated by the arc extinguishing permanent magnet, and cut-off voltage is raised, thus extinguishing the arc.

However, when the arc is extended and the cut-off voltage is raised, there is an unsolved problem in that there is no longer any cut-off time, the edge of the arc moves above the fixed contact, the current path changes, no driving force is received from the magnetic field formed by the arc extinguishing permanent magnet, and it is not possible to extend the arc in the desired direction.

Also, there is also an unsolved problem in that the leading edge of the extended arc contacts with the fixed contact, the arc is short-circuited, the arc voltage drops, and cut-off is no longer possible.

Therefore, the invention, conceiving the unsolved problems of the heretofore known example, has an object of providing an electromagnetic contactor such that it is possible to regulate an arc generation position, thereby reliably carrying out arc extinguishing.

Solution to Problem

In order to achieve the heretofore described object, an electromagnetic contactor according to one aspect of the invention includes a contact device including a pair of fixed contacts disposed maintaining a predetermined distance and a movable contact disposed so as to be capable of contacting to and separating from the pair of fixed contacts, wherein an insulating cover covering all except contact portions contacting with the movable contact is mounted on the pair of fixed contacts.

According to this configuration, as all of the fixed contacts except the contact portions that contact with the movable contact is covered with the insulating cover, it is possible, even in the event that an arc is generated when the movable contact separates from the fixed contacts from an engaged condition wherein the movable contact is in contact with the fixed contacts, to reliably prevent the end portion of the arc from moving above the fixed contacts. In the same way, it is possible to reliably prevent the leading edge of the extended arc from contacting with the fixed contacts, the arc being short-circuited, and the arc voltage dropping.

Also, the electromagnetic contactor according to another aspect of the invention is such that the pair of fixed contacts includes a support conductor portion supported maintaining a predetermined interval with the upper surface of a contact housing case, and a C-shaped portion formed, in a C-shape, of an upper plate portion connected to an end portion of the support conductor portion inside the contact housing case, an intermediate plate portion extending downward from a side of the upper plate portion opposite to another support conductor portion, and a lower plate portion formed with the contact portion on an upper surface and extending from a lower end of the intermediate plate portion to a side of the support conductor portion. The insulating cover is configured so as to expose at least the contact portions of the C-shaped portion and to cover a surface facing the movable contact and side surfaces connected to the surface facing the movable contact.

According to this configuration, as the fixed contacts are formed in a C-shaped portion, it is possible, even in the event that an electromagnetic repulsion force is generated in the contact portions of the fixed contacts and movable contact when the contacts of the contact device are closed, to generate a Lorentz force that opposes the electromagnetic repulsion force in the C-shaped portion. Subsequently, when an arc is generated between the fixed contacts and movable contact when the movable contact separates from the fixed contacts, it is possible, as only the contact portions are exposed by the insulating cover, to reliably prevent the arc from moving above the fixed contacts and the current path changing.

Also, the electromagnetic contactor according to another aspect of the invention is such that the insulating cover includes an L-shaped portion that covers the inner surfaces of the upper plate portion and intermediate plate portion of the C-shaped portion of the pair of fixed contacts, side plate portions that extend from side edges of the L-shaped portion so as to cover side surfaces of the C-shaped portion, and a fitting portion extending inward from upper ends of the side plate portions facing the support conductor portion and fitting onto a small diameter portion formed on the support conductor portion.

According to this configuration, it is possible to install the insulating cover on the fixed contacts simply by the fitting portion of the insulating cover being fitted onto the small diameter portion formed on the support conductor portion, and thus possible to easily carry out the installation of the insulating cover.

Also, the electromagnetic contactor according to another aspect of the invention is such that the insulating cover includes an L-shaped portion that covers the inner surfaces of the upper plate portion and intermediate plate portion of the C-shaped portion of the pair of fixed contacts, side plate portions that extend from side edges of the L-shaped portion so as to cover side surfaces of the C-shaped portion, a fitting portion extending inward from upper ends of the side plate portions facing the support conductor portion and fitting onto a small diameter portion formed on the support conductor portion, and a snap-fitting portion that engages with a protrusion formed on the lower surface of the lower plate portion of the C-shaped portion.

According to this configuration, it is possible to install the insulating cover on the fixed contacts simply by the snap-fitting portion being engaged on the protrusion of the lower plate portion of the C-shaped portion at the same time as the fitting portion of the insulating cover is fitted onto the small diameter portion formed on the support conductor portion, and thus possible to easily and reliably carry out the installation of the insulating cover.

Advantageous Effects of Invention

According to the invention, in a configuration having an L-shaped portion and C-shaped portion, wherein Lorentz force is generated opposing electromagnetic repulsion force in an engaged condition, all except the contact portions of the fixed contacts is covered by the insulating cover, thus, it is possible to reliably prevent an arc generated when changing from the engaged condition to a released condition from moving above the fixed contacts. Also, it is also possible to prevent the leading edge of the arc from short circuiting in a portion other than the contact portions of the fixed contacts. Consequently, it is possible to stably extend the arc even when the cut-off voltage rises, and thus possible to reliably carry out arc extinguishing, and reliably interrupt the current.

DESCRIPTION OF EMBODIMENTS

Hereafter, a description will be given, based on the drawings, of an embodiment of the invention.

Figure 1:
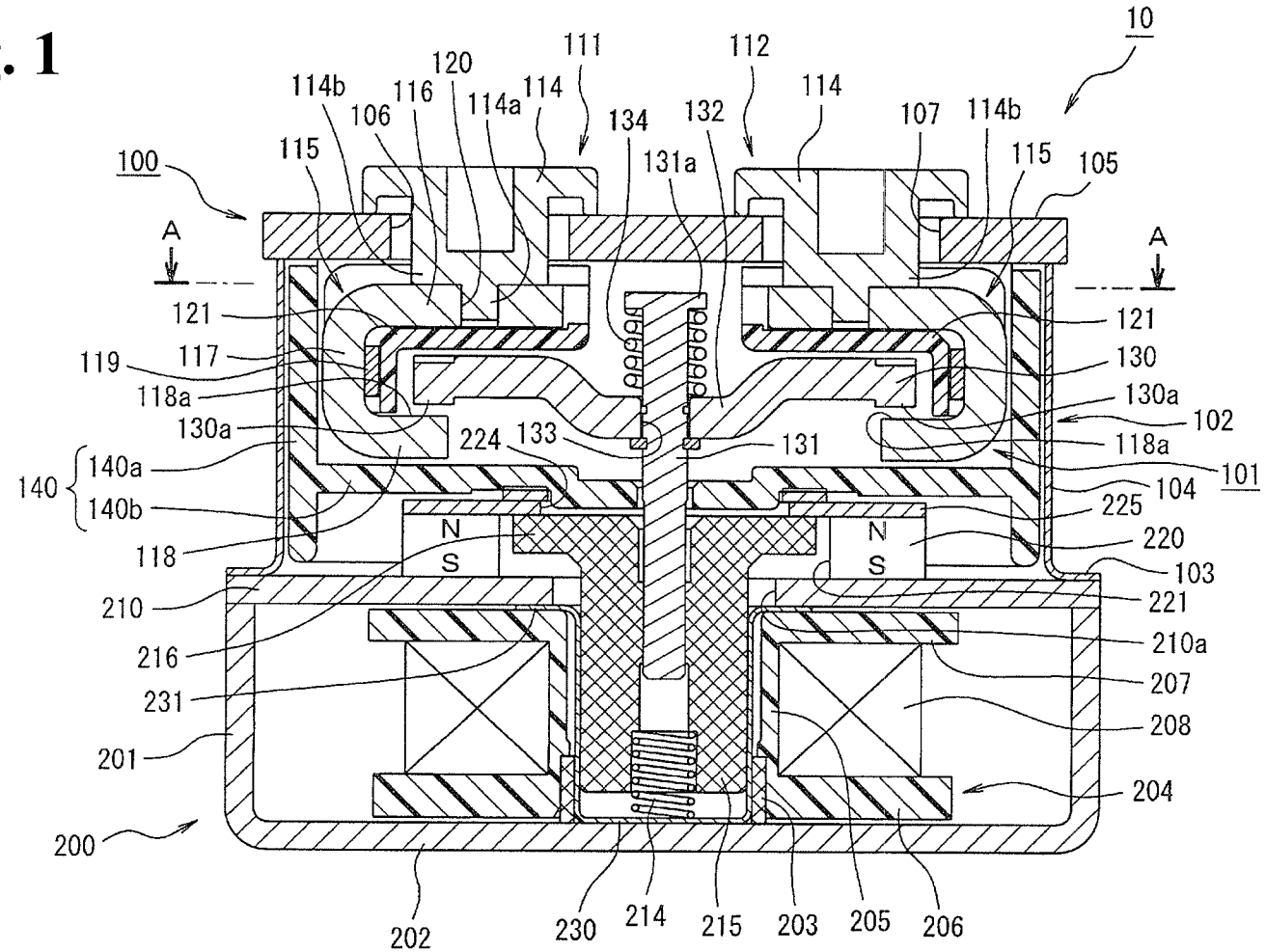
FIG. 1 is a sectional view showing a first embodiment of an electromagnetic contactor according to the invention.
Figure 2B:
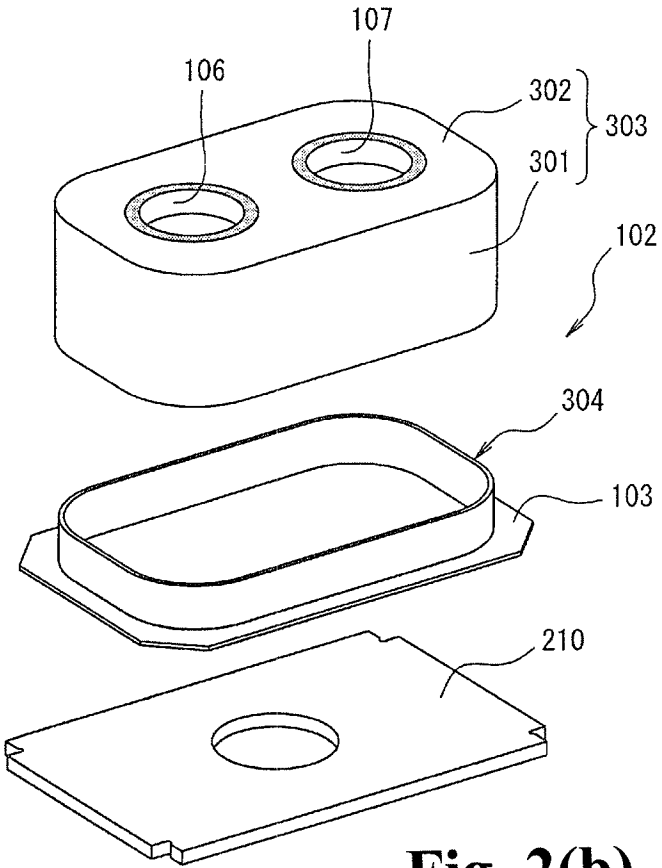
FIGS. 2(*a*), 2(*b*) are exploded perspective views showing a contact housing case of FIG. 1.
Figure 2A:
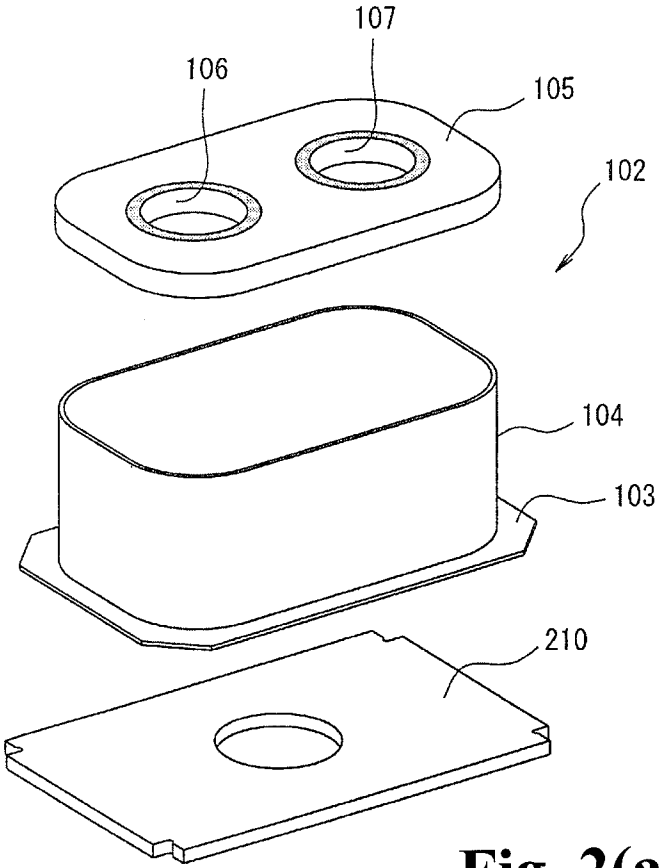

FIG. 1 is a sectional view showing one example of an electromagnetic contactor according to the invention, while FIGS. 2(*a*), 2(*b*) are an exploded perspective view of a contact housing case. In FIG. 1, FIGS. 2(*a*) and 2(*b*), numeral 10 is an electromagnetic contactor, and the electromagnetic contactor 10 is configured of a contact device 100 in which is disposed a contact mechanism, and an electromagnet unit 200 that drives the contact device 100.

The contact device 100 has a contact housing case 102 that houses a contact mechanism 101, as is clear from FIG. 1 and FIGS. 2(*a*), 2(*b*). The contact housing case 102, as shown in FIG. 2(*a*), includes a metal tubular body 104 having on a lower end portion a metal flange portion 103 protruding outward, and a fixed contact support insulating substrate 105 configured of a plate-like ceramic insulating substrate that closes off the upper end of the metal tubular body 104.

The metal tubular body 104 is such that the flange portion 103 thereof is seal joined and fixed to an upper portion magnetic yoke 210 of the electromagnet unit 200, to be described hereafter.

Also, through holes 106 and 107 in which is inserted a pair of fixed contacts 111 and 112, to be described hereafter, are formed maintaining a predetermined interval in a central portion of the fixed contact support insulating substrate 105. A metalizing process is performed around the through holes 106 and 107 on the upper surface side of the fixed contact support insulating substrate 105, and in a position on the lower surface side that contacts with the tubular body 104. Further, the fixed contact support insulating substrate 105 is brazed to the upper surface of the metal tubular body 104.

The contact mechanism 101, as shown in FIG. 1, includes the pair of fixed contacts 111 and 112 inserted into and fixed in the through holes 106 and 107 of the fixed contact support insulating substrate 105 of the contact housing case 102. Each of the fixed contacts 111 and 112 includes a support conductor portion 114, having on an upper end a flange portion protruding outward, inserted into the through holes 106 and 107 of the fixed contact support insulating substrate 105, and a C-shaped portion 115, the inner side of which is opened, linked to the support conductor portion 114 and disposed on the lower surface side of the fixed contact support insulating substrate 105.

The C-shaped portion 115 is formed in a C-shape of an upper plate portion 116 extending to the outer side along the line of the lower surface of the fixed contact support insulating substrate 105, an intermediate plate portion 117 extending downward from the outer side end portion of the upper plate portion 116, and a lower plate portion 118 extending from the lower end side of the intermediate plate portion 117, parallel with the upper plate portion 116, to the inner side, that is, in a direction facing the fixed contacts 111 and 112, wherein the upper plate portion 116 is added to an L-shape formed by the intermediate plate portion 117 and lower plate portion 118.

Herein, the support conductor portion 114 and C-shaped portion 115 are fixed by, for example, brazing in a condition in which a pin 114*a* formed protruding on the lower end surface of the support conductor portion 114 is inserted into a through hole 120 formed in the upper plate portion 116 of the C-shaped portion 115. The fixing of the support conductor portion 114 and C-shaped portion 115, not being limited to brazing, may be such that the pin 114*a* is fitted into the through hole 120, or an external thread is formed on the pin 114*a* and an internal thread formed in the through hole 120, and the two are screwed together.

Also, a magnetic plate 119 of a C-shape when seen in plan view is mounted so as to cover the inner side surface of the intermediate plate portion 117 in the C-shaped portion 115 of the fixed contacts 111 and 112. By disposing the magnetic plate 119 so as to cover the inner side surface of the intermediate plate portion 117 in this way, it is possible to shield a magnetic field generated by current flowing through the intermediate plate portion 117.

Because of this, in the event that an arc is generated when, from a condition in which contact portions 130*a* of a movable contact 130 are in contact with contact portions 118*a* of the fixed contacts 111 and 112, the contact portions 130*a* move away upward, as will be described hereafter, it is possible to prevent interference between a magnetic field caused by the current flowing through the intermediate plate portion 117 and a magnetic field caused by the arc generated between the contact portions 118*a* of the fixed contacts 111 and 112 and the contact portions 130*a* of the movable contact 130.

Consequently, it is possible to prevent the two magnetic fields from repelling each other, the arc being moved to the inner side along the line of the movable contact 130 by this electromagnetic repulsion, and interruption of the arc becoming difficult. It being sufficient that it is possible to shield a magnetic field generated by current flowing through the intermediate plate portion 117, the magnetic plate 119 may be formed so as to cover the periphery of the intermediate plate portion 117.

Further, an insulating cover 121, made of a synthetic resin material, that regulates arc generation is mounted on the C-shaped portion 115 of each of the fixed contacts 111 and 112. The insulating cover 121 covers the inner peripheral surfaces of the upper plate portion 116 and intermediate plate portion 117 of the C-shaped portion 115, as shown in FIGS. 3(*a*) and 3(*b*).

The insulating cover 121 includes an L-shaped plate portion 122 that follows the inner peripheral surfaces of the upper plate portion 116 and intermediate plate portion 117, side plate portions 123 and 124, each extending upward and outward from front and rear end portions of the L-shaped plate portion 122, that cover side surfaces of the upper plate portion 116 and intermediate plate portion 117 of the C-shaped portion 115, and a fitting portion 125, formed on the inward side from the upper end of the side plate portions 123 and 124, that fits onto a small diameter portion 114*b* formed on the support conductor portion 114 of the fixed contacts 111 and 112.

Figure 3A:
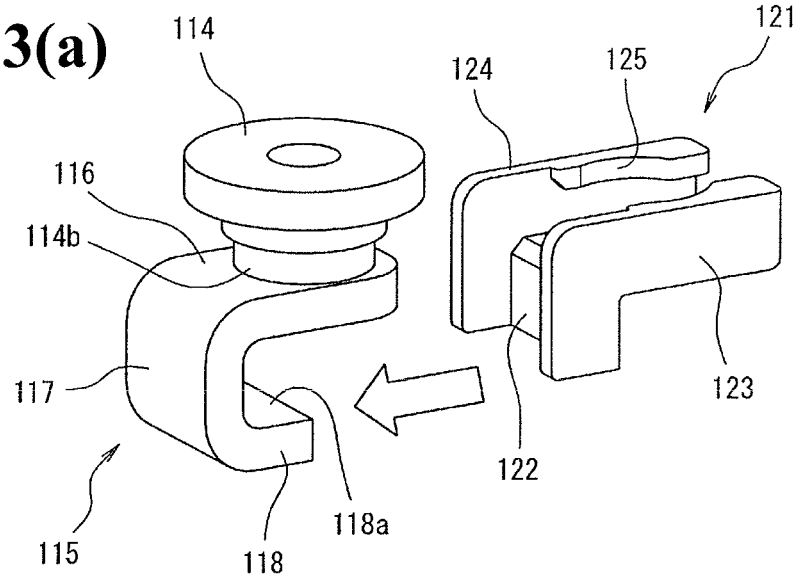
FIGS. 3(*a*)-3(*c*) are diagrams showing an insulating cover of a contact mechanism, wherein FIG. 3(*a*) is a perspective view, FIG. 3(*b*) is a plan view before mounting, and FIG. 3(*c*) is a plan view after mounting.
Figure 3B:
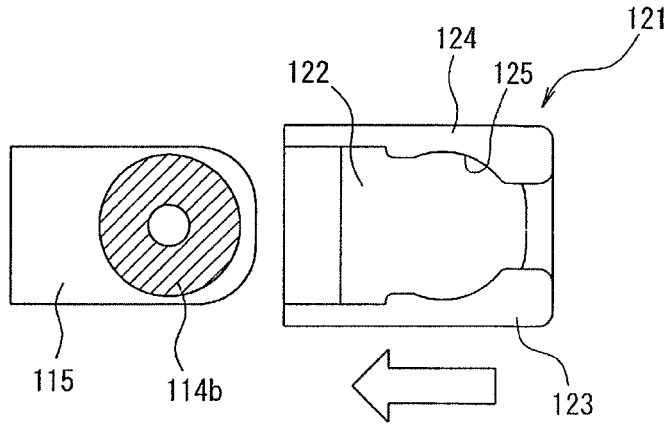
Figure 3C:
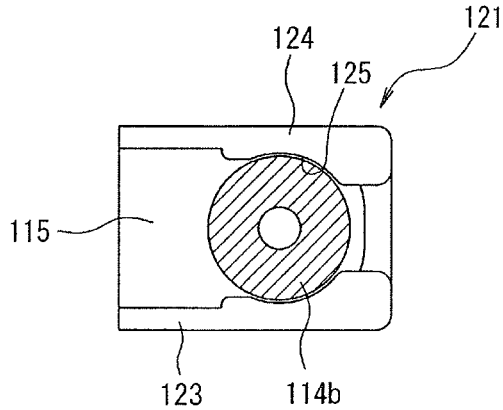

Consequently, the insulating cover 121 is placed in a condition in which the fitting portion 125 is facing the small diameter portion 114*b* of the support conductor portion 114 of the fixed contacts 111 and 112, as shown in FIGS. 3(*a*) and 3(*b*), after which, as shown in FIG. 3(*c*), the fitting portion 125 is fitted onto the small diameter portion 114*b* of the support conductor portion 114 by pushing the insulating cover 121.

Figure 4A:
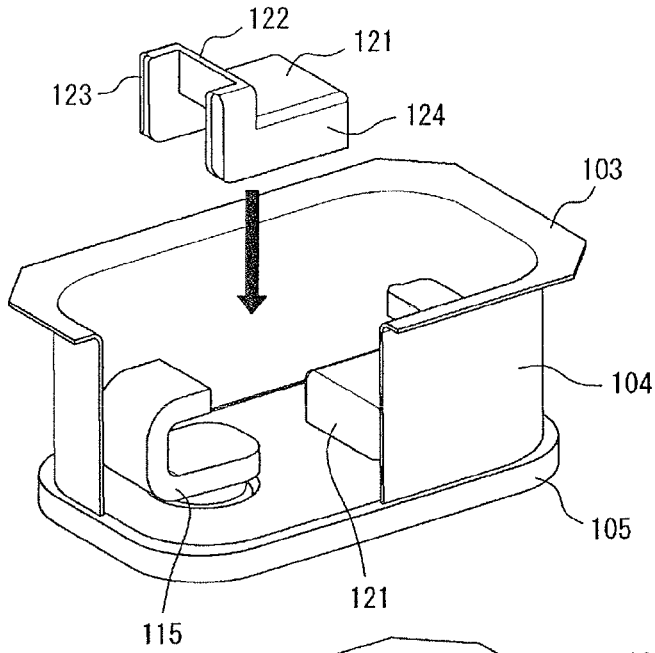
FIGS. 4(*a*)-4(*d*) are perspective views showing an insulating cover mounting method.
Figure 4B:
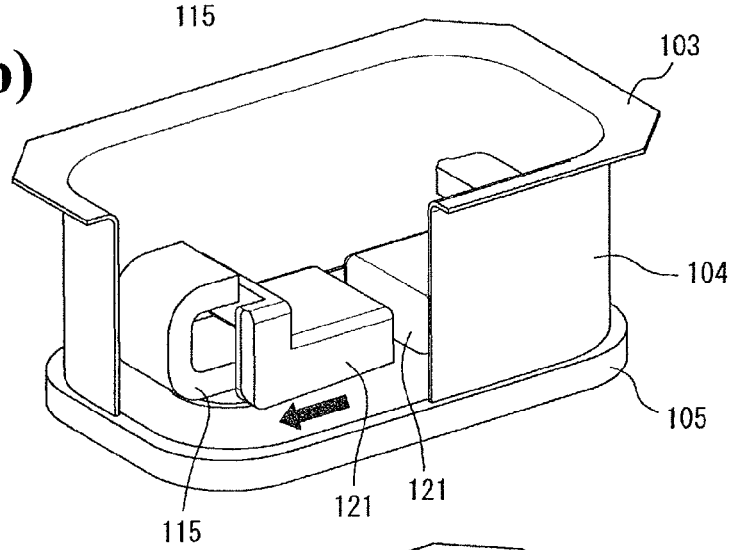
Figure 4C:
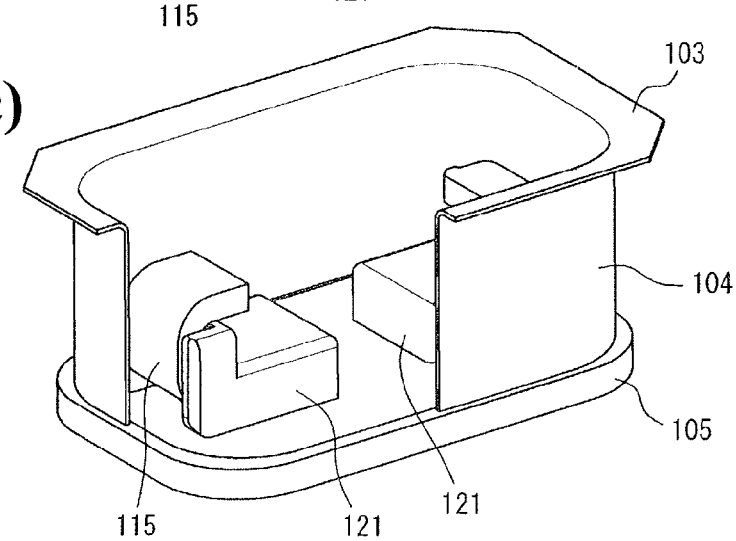

Actually, with the contact housing case 102 after the fixed contacts 111 and 112 have been attached in a condition wherein the fixed contact support insulating substrate 105 is on the lower side, the insulating cover 121 is inserted from an upper aperture portion between the fixed contacts 111 and 112 in a condition vertically the reverse of that in FIGS. 3(*a*) to 3(*c*), as shown in FIG. 4(*a*).

Next, in a condition in which the fitting portion 125 is in contact with the fixed contact support insulating substrate 105, as shown in FIG. 4(*b*), the fitting portion 125 is engaged with and fixed to the small diameter portion 114*b* of the support conductor portion 114 of the fixed contacts 111 and 112 by pushing the insulating cover 121 to the outer side, as shown in FIG. 4(*c*).

By mounting the insulating cover 121 on the C-shaped portion 115 of the fixed contacts 111 and 112 in this way, only the upper surface side of the lower plate portion 118 of the inner peripheral surface of the C-shaped portion 115 is exposed, and is taken to be the contact portion 118*a*.

Figure 5:
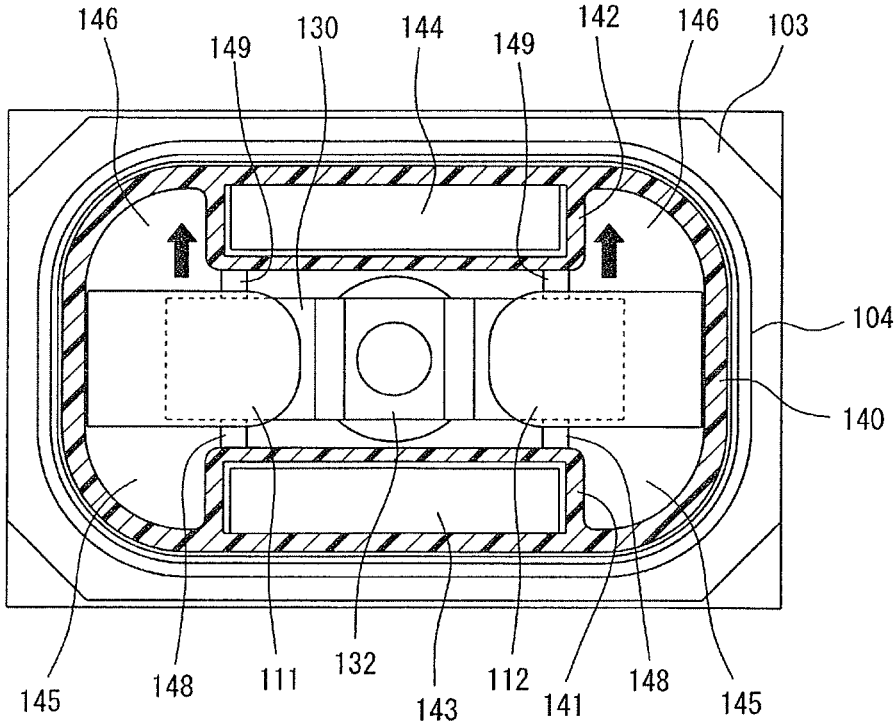
FIG. 5 is a sectional view along line A-A in FIG. 1.

Further, the movable contact 130 is disposed in such a way that both end portions are disposed in the C-shaped portion 115 of the fixed contacts 111 and 112. The movable contact 130 is supported by a connecting shaft 131 fixed to a movable plunger 215 of the electromagnet unit 200, to be described hereafter. The movable contact 130 is such that, as shown in FIG. 1 and FIG. 5, a central portion in the vicinity of the connecting shaft 131 protrudes downward, whereby a depressed portion 132 is formed, and a through hole 133 in which the connecting shaft 131 is inserted is formed in the depressed portion 132.

A flange portion 131*a* protruding outward is formed on the upper end of the connecting shaft 131. The connecting shaft 131 is inserted from the lower end side into a contact spring 134, then inserted into the through hole 133 of the movable contact 130, bringing the upper end of the contact spring 134 into contact with the flange portion 131*a*, and the moving contact 130 is positioned using, for example, a C-ring 135 so as to obtain a predetermined urging force from the contact spring 134.

The movable contact 130, in a released condition, takes on a condition wherein the contact portions 130*a* at either end and the contact portions 118*a* of the lower plate portions 118 of the C-shaped portions 115 of the fixed contacts 111 and 112 are separated from each other and maintaining a predetermined interval. Also, the movable contact 130 is set so that, in an engaged position, the contact portions at either end contact with the contact portions 118*a* of the lower plate portions 118 of the C-shaped portions 115 of the fixed contacts 111 and 112 at a predetermined contact pressure due to the contact spring 134.

Furthermore, an insulating cylinder 140 formed in a bottomed tubular form of a tubular portion 140*a* and a bottom plate portion 140*b* formed on the lower surface side of the tubular portion 140*a* is disposed on the inner peripheral surface of the metal tubular body 104 of the contact housing case 102, as shown in FIG. 1. The insulating cylinder 140 is made of, for example, a synthetic resin, and the tubular portion 140*a* and bottom plate portion 140*b* are formed integrally. Magnet housing cylinders 141 and 142 are formed integrally as magnet housing portions in positions on the insulating cylinder 140 facing the side surfaces of the movable contact 130. Arc extinguishing permanent magnets 143 and 144 are inserted into and fixed in the magnet housing cylinders 141 and 142.

The arc extinguishing permanent magnets 143 and 144 are magnetized in a thickness direction so that mutually opposing faces thereof are homopolar, for example, N-poles. Also, the arc extinguishing permanent magnets 143 and 144 are set so that both end portions in a left-right direction are slightly inward of positions in which the contact portions 118*a* of the fixed contacts 111 and 112 and the contact portions of the movable contact 130 are opposed, as shown in FIG. 5. Further, arc extinguishing spaces 145 and 146 are formed on the outer sides in a left-right direction, that is, the longitudinal direction of the movable contact, of the magnet housing cylinders 141 and 142 respectively.

Also, movable contact guide members 148 and 149, which regulate the turning of the movable contact 130, are formed protruding, sliding against side edges of the magnet housing cylinders 141 and 142 toward either end of the movable contact 130.

Consequently, the insulating cylinder 140 includes a function of positioning the arc extinguishing permanent magnets 143 and 144 using the magnet housing cylinders 141 and 42, a protective function of protecting the arc extinguishing permanent magnets 143 and 144 from an arc, and an insulating function preventing the arc from affecting the metal tubular body 104, which increases external rigidity.

Further, by disposing the arc extinguishing permanent magnets 143 and 144 on the inner peripheral surface side of the insulating cylinder 140 in this way, it is possible to bring the arc extinguishing permanent magnets 143 and 144 near to the movable contact 130. Because of this, as shown in FIG. 6(*a*), magnetic flux $\phi$ emanating from the N-pole sides of the two arc extinguishing permanent magnets 143 and 144 crosses portions in which the contact portions 118*a* of the fixed contacts 111 and 112 and the contact portions 130*a* of the movable contact 130 are opposed in a left-right direction, from the inner side to the outer side, with a large flux density.

Figure 6A:
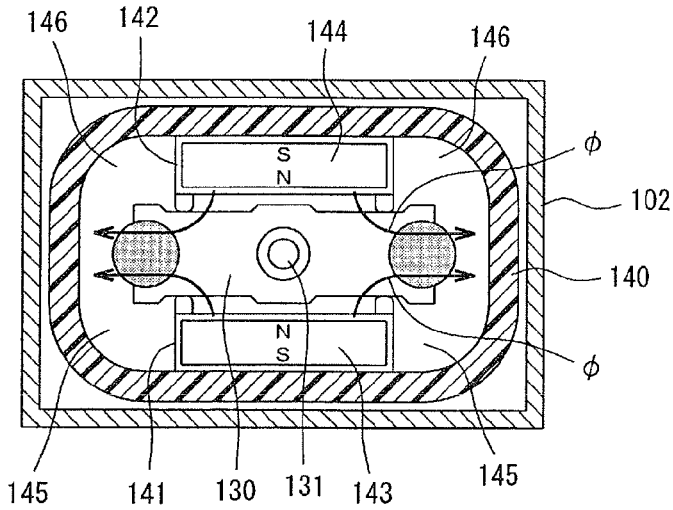
FIGS. 6(*a*)-6(*c*) are drawings accompanying a description of arc extinguishing by an arc extinguishing permanent magnet according to the invention.
Figure 6B:
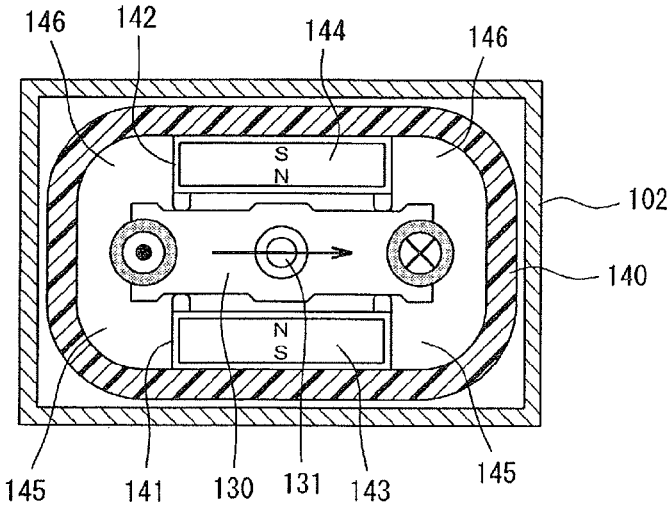
Figure 6C:
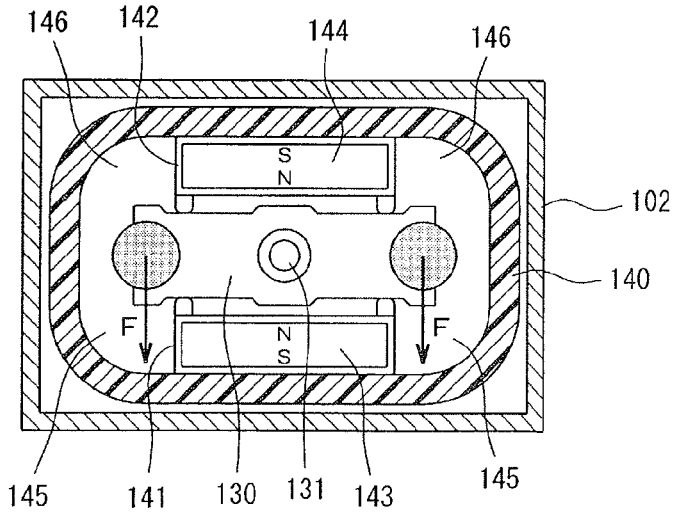

Consequently, assuming that the fixed contact 111 is connected to a current supply source and the fixed contact 112 is connected to a load side, the current direction in the engaged condition is such that the current flows from the fixed contact 111 through the movable contact 130 to the fixed contact 112, as shown in FIG. 6(*b*). Then, when changing from the engaged condition to the released condition by causing the movable contact 130 to move away upward from the fixed contacts 111 and 112, an arc is generated between the contact portions 118*a* of the fixed contacts 111 and 112 and the contact portions 130*a* of the movable contact 130.

The arc is extended to the arc extinguishing space 145 side on the arc extinguishing permanent magnet 143 side by the magnetic flux $\phi$ from the arc extinguishing permanent magnets 143 and 144. At this time, as the arc extinguishing spaces 145 and 146 are formed as widely as the thickness of the arc extinguishing permanent magnets 143 and 144, it is possible to obtain a long arc length, and thus possible to reliably extinguish the arc.

Figure 7A:
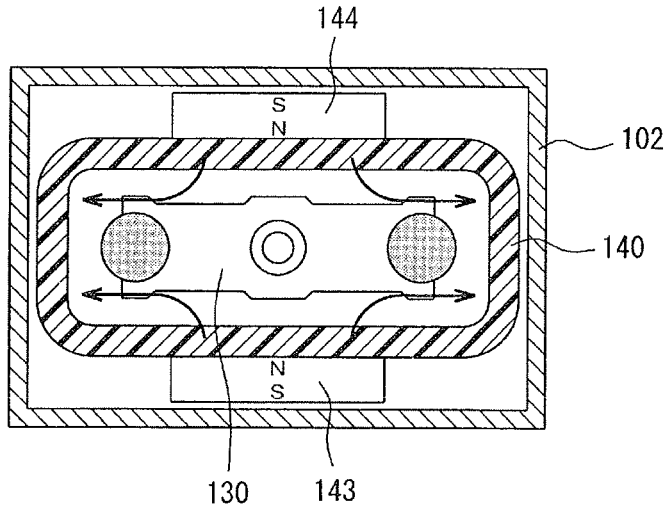
FIGS. 7(*a*)-7(*c*) are drawings accompanying a description of arc extinguishing when the arc extinguishing permanent magnet is disposed on the outer side of an insulating case.
Figure 7B:
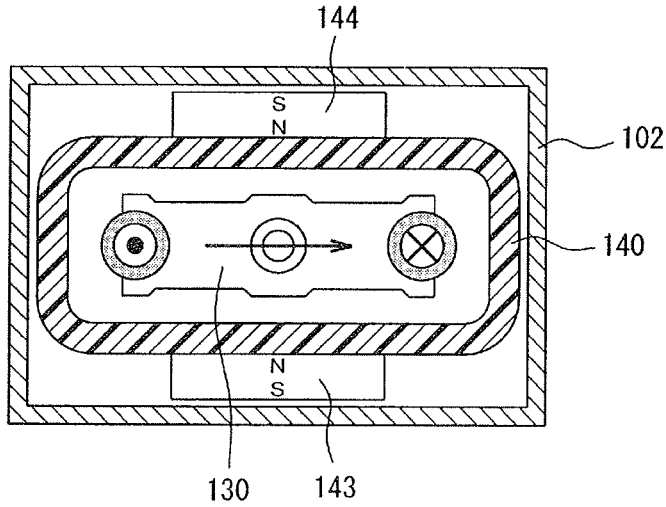
Figure 7C:
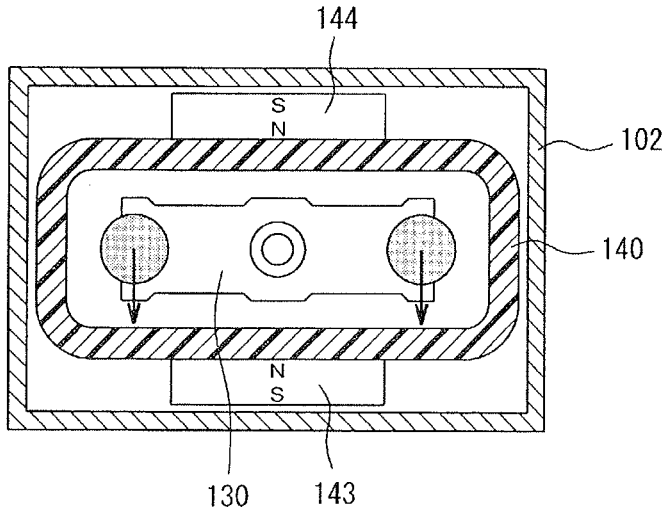

Incidentally, when the arc extinguishing permanent magnets 143 and 144 are disposed on the outer side of the insulating cylinder 140, as shown in FIGS. 7(*a*) to 7(*c*), there is an increase in the distance to the positions in which the contact portions 118*a* of the fixed contacts 111 and 112 and the contact portions 130*a* of the movable contact 130 are opposed, and when the same permanent magnets as in this embodiment are applied, the density of the magnetic flux crossing the arc decreases.

Because of this, the Lorentz force acting on an arc generated when shifting from the engaged condition to the released condition decreases, and it is no longer possible to sufficiently extend the arc. In order to improve the arc extinguishing performance, it is necessary to increase the magnetization of the arc extinguishing permanent magnets 143 and 144. Moreover, in order to shorten the distance between the arc extinguishing permanent magnets 143 and 144 and the contact portions of the fixed contacts 111 and 112 and movable contact 130, it is necessary to reduce the depth in a front-back direction of the insulating cylinder 140, and there is a problem in that it is not possible to secure sufficient arc extinguishing space to extinguish the arc.

However, according to the heretofore described embodiment, the arc extinguishing permanent magnets 143 and 144 are disposed on the inner side of the insulating cylinder 140, meaning that the problems occurring when the arc extinguishing permanent magnets 143 and 144 are disposed on the outer side of the insulating cylinder 140 can all be solved.

The electromagnet unit 200, as shown in FIG. 1, has a magnetic yoke 201 of a flattened U-shape when seen from the side, and a cylindrical auxiliary yoke 203 is fixed in a central portion of a bottom plate portion 202 of the magnetic yoke 201. A spool 204 is disposed on the outer side of the cylindrical auxiliary yoke 203.

The spool 204 is configured of a central cylinder portion 205 in which the cylindrical auxiliary yoke 203 is inserted, a lower flange portion 206 protruding outward in a radial direction from a lower end portion of the central cylinder portion 205, and an upper flange portion 207 protruding outward in a radial direction from slightly below the upper end of the central cylinder portion 205. Further, an exciting coil 208 is mounted wound in a housing space configured of the central cylinder portion 205, lower flange portion 206, and upper flange portion 207.

Further, an upper magnetic yoke 210 is fixed between upper ends forming an opened end of the magnetic yoke 201. A through hole 210*a* facing the central cylinder portion 205 of the spool 204 is formed in a central portion of the upper magnetic yoke 210.

Further, the movable plunger 215, in which is disposed a return spring 214 between a bottom portion and the bottom plate portion 202 of the magnetic yoke 201, is disposed in the central cylinder portion 205 of the spool 204 so as to be able to slide up and down. A peripheral flange portion 216 protruding outward in a radial direction is formed on the movable plunger 215, on an upper end portion protruding upward from the upper magnetic yoke 210.

Also, a permanent magnet 220 formed in a ring-form, whose external form is, for example, rectangular and which has a circular central aperture 221, is fixed to the upper surface of the upper magnetic yoke 210 so as to enclose the peripheral flange portion 216 of the movable plunger 215. The permanent magnet 220 is magnetized in an up-down direction, that is, a thickness direction, so that the upper end side is, for example, an N-pole while the lower end side is an S-pole. Taking the form of the central aperture 221 of the permanent magnet 220 to be a form custom to the form of the peripheral flange portion 216; the form of the outer peripheral surface can be any form, such as circular or rectangular.

Further, an auxiliary yoke 225 of the same external form as the permanent magnet 220, and having a through hole 224 with an inner diameter smaller than the outer diameter of the peripheral flange portion 216 of the movable plunger 215, is fixed to the upper end surface of the permanent magnet 220. The peripheral flange portion 216 of the movable plunger 215 is brought into contact with the lower surface of the auxiliary yoke 225.

Also, the connecting shaft 131 that supports the movable contact 130 is screwed to the upper end surface of the movable plunger 215.

Further, the movable plunger 215 is covered with a cap 230 formed in a bottomed tubular form made of a non-magnetic body, and a flange portion 231 formed extending outward in a radial direction on an opened end of the cap 230 is seal joined to the lower surface of the upper magnetic yoke 210. By so doing, a hermetic receptacle, wherein the contact housing case 102 and cap 230 are in communication via the through hole 210*a* of the upper magnetic yoke 210, is formed. Further, a gas such as hydrogen gas, nitrogen gas, a mixed gas of hydrogen and nitrogen, air, or $SF_6$ is encapsulated inside the hermetic receptacle formed by the contact housing case 102 and cap 230.

Next, a description will be given of an operation of the heretofore described embodiment.

For now, it is assumed that the fixed contact 111 is connected to, for example, a power supply source that supplies a large current, while the fixed contact 112 is connected to a load.

In this condition, the exciting coil 208 in the electromagnet unit 200 is in a non-excited state, and there exists a released condition wherein no exciting force causing the movable plunger 215 to descend is being generated in the electromagnet unit 200. In this released condition, the movable plunger 215 is urged in an upward direction away from the upper magnetic yoke 210 by the return spring 214. Simultaneously with this, an attracting force caused by a magnet force of the permanent magnet 220 acts on the auxiliary yoke 225, and the peripheral flange portion 216 of the movable plunger 215 is attracted. Because of this, the upper surface of the peripheral flange portion 216 of the movable plunger 215 contacts with the lower surface of the auxiliary yoke 225.

Because of this, the contact portions 130*a* of movable contact 130 in the contact mechanism 101 connected to the movable plunger 215 via the connecting shaft 131 are separated by a predetermined distance upward from the contact portions 118*a* of the fixed contacts 111 and 112. Because of this, the current path between the fixed contacts 111 and 112 is in an interrupted condition, and the contact mechanism 101 is in a condition wherein the contacts are opened.

In this way, as the urging force of the return spring 214 and the attracting force of the ring-form permanent magnet 220 both act on the movable plunger 215 in the released condition, there is no unplanned downward movement of the movable plunger 215 due to external vibration, shock, or the like, and it is thus possible to reliably prevent malfunction.

On the exciting coil 208 of the electromagnet unit 200 being excited in the released condition, an exciting force is generated in the electromagnet unit 200, and the movable plunger 215 is pressed downward against the urging force of the return spring 214 and the attracting force of the ring-form permanent magnet 220.

Further, the movable plunger 215 descends swiftly against the urging force of the return spring 214 and the attracting force of the ring-form permanent magnet 220. Because of this, the descent of the movable plunger 215 is stopped by the lower surface of the peripheral flange portion 216 contacting with the upper surface of the upper magnetic yoke 210.

By the movable plunger 215 descending in this way, the movable contact 130 connected to the movable plunger 215 via the connecting shaft 131 also descends, and the contact portions 130*a* of the movable contact 130 contact with the contact portions 118*a* of the fixed contacts 111 and 112 with the contact pressure of the contact spring 134.

Because of this, there exists a closed contact condition wherein the large current of the external power supply source is supplied via the fixed contact 111, movable contact 130, and fixed contact 112 to the load.

At this time, an electromagnetic repulsion force is generated between the fixed contacts 111 and 112 and the movable contact 130 in a direction such as to cause the contacts of the movable contact 130 to open.

However, as the fixed contacts 111 and 112 are such that the C-shaped portion 115 is formed of the upper plate portion 116, intermediate plate portion 117, and lower plate portion 118, as shown in FIG. 1, the current in the upper plate portion 116 and lower plate portion 118 and the current in the opposing movable contact 130 flow in opposite directions. Because of this, from the relationship between a magnetic field formed by the lower plate portions 118 of the fixed contacts 111 and 112 and the current flowing through the movable contact 130, it is possible, in accordance with Fleming's left-hand rule, to generate a Lorentz force that presses the movable contact 130 against the contact portions 118*a* of the fixed contacts 111 and 112.

Because of this Lorentz force, it is possible to oppose the electromagnetic repulsion force generated in the contact opening direction between the contact portions 118*a* of the fixed contacts 111 and 112 and the contact portions 130*a* of the movable contact 130, and thus possible to reliably prevent the contact portions 130*a* of the movable contact 130 from opening. Because of this, it is possible to reduce the pressing force of the contact spring 134 supporting the movable contact 130, and also possible to reduce thrust generated in the exciting coil 208 in response to the pressing force, and it is thus possible to reduce the size of the overall configuration of the electromagnetic contactor.

When interrupting the supply of current to the load in the closed contact condition of the contact mechanism 101, the exciting of the exciting coil 208 of the electromagnet unit 200 is stopped.

By so doing, the exciting force causing the movable plunger 215 to move downward in the electromagnet unit 200 stops, the movable plunger 215 is raised by the urging force of the return spring 214, and the attracting force of the ring-form permanent magnet 220 increases as the peripheral flange portion 216 nears the auxiliary yoke 225.

By the movable plunger 215 rising, the movable contact 130 connected via the connecting shaft 131 rises. As a result of this, the movable contact 130 is in contact with the fixed contacts 111 and 112 for as long as contact pressure is applied by the contact spring 134. Subsequently, there starts an opened Contact condition, wherein the movable contact 130 moves upward away from the fixed contacts 111 and 112 at the point at which the contact pressure of the contact spring 134 stops.

On the opened contact condition starting, an arc is generated between the contact portions 118*a* of the fixed contacts 111 and 112 and the contact portions 130*a* of the movable contact 130, and the condition in which current is conducted is continued due to the arc. At this time, as the insulating cover 121 is mounted covering the upper plate portion 116 and intermediate plate portion 117 of the C-shaped portion 115 of the fixed contacts 111 and 112, it is possible to cause the arc to be generated only between the contact portions 118*a* of the fixed contacts 111 and 112 and the contact portions 130*a* of the movable contact 130. Because of this, it is possible to reliably prevent the arc from moving above the C-shaped portion 115 of the fixed contacts 111 and 112, thereby stabilizing the arc generation condition, and thus possible to improve arc extinguishing performance. Moreover, as both side surfaces of the fixed contacts 111 and 112 are also covered by the insulating cover 121, it is also possible to reliably prevent the leading edge of the arc from short circuiting.

Also, as the upper plate portion 116 and intermediate plate portion 117 of the C-shaped portion 115 are covered by the insulating cover 121, it is possible to maintain insulating distance with the insulating cover 121 between the two end portions of the movable contact 130 and the upper plate portion 116 and intermediate plate portion 117 of the C-shaped portion 115, and thus possible to reduce the height in the movable direction of the movable contact 130. Consequently, it is possible to reduce the size of the contact device 100.

Furthermore, as the insulating cover 121 can be mounted on the fixed contacts 111 and 112 simply by the fitting portion 125 being fitted onto the small diameter portion 114*b* of the fixed contacts 111 and 112, it is possible to easily carry out the mounting of the insulating cover 121 on the fixed contacts 111 and 112.

Also, as the inner surface of the intermediate plate portion 117 of the fixed contacts 111 and 112 is covered by the magnetic plate 119, a magnetic field generated by current flowing through the intermediate plate portion 117 is shielded by the magnetic plate 119. Because of this, there is no interference between a magnetic field caused by the arc generated between the contact portions 118*a* of the fixed contacts 111 and 112 and the contact portions 130*a* of the movable contact 130 and the magnetic field caused by the current flowing through the intermediate plate portion 117, and it is thus possible to prevent the arc from being affected by the magnetic field generated by the current flowing through the intermediate plate portion 117.

Meanwhile, as the opposing magnetic pole faces of the arc extinguishing permanent magnets 143 and 144 are N-poles, and the outer sides thereof are S-poles, magnetic flux emanating from the N-poles, seen in plan view as shown in FIG. 6(*a*), crosses an arc generation portion of a portion in which the contact portion 118*a* of the arc extinguishing permanent magnets 143 and 144 fixed contact 111 and the contact portion 130*a* of the movable contact 130 are facing each other, from the inner side to the outer side in the longitudinal direction of the movable contact 130, and reaches the S-pole, whereby a magnetic field is formed. In the same way, the magnetic flux crosses an arc generation portion of the contact portion 118*a* of the fixed contact 112 and the contact portion 130*a* of the movable contact 130, from the inner side to the outer side in the longitudinal direction of the movable contact 130, and reaches the S-pole, whereby a magnetic field is formed.

Consequently, the magnetic fluxes of the arc extinguishing permanent magnets 143 and 144 both cross between the contact portion 118*a* of the fixed contact 111 and the contact portion 130*a* of the movable contact 130 and between the contact portion 118*a* of the fixed contact 112 and the contact portion 130*a* of the movable contact 130, in mutually opposite directions in the longitudinal direction of the movable contact 130.

Because of this, a current I flows from the fixed contact 111 side to the movable contact 130 side between the contact portion 118*a* of the fixed contact 111 and the contact portion 130*a* of the movable contact 130, and the orientation of the magnetic flux $\phi$ is in a direction from the inner side toward the outer side, as shown in FIG. 6(*b*). Because of this, in accordance with Fleming's left-hand rule, a large Lorentz force F acts toward the arc extinguishing space 145, perpendicular to the longitudinal direction of the movable contact 130 and perpendicular to the switching direction of the contact portion 118*a* of the fixed contact 111 and the movable contact 130, as shown in FIG. 6(*c*).

Due to the Lorentz force F, an arc generated between the contact portion 118*a* of the fixed contact 111 and the contact portion 130*a* of the movable contact 130 is greatly extended so as to pass from the side surface of the contact portion 118*a* of the fixed contact 111 through the inside of the arc extinguishing space 145, reaching the upper surface side of the movable contact 130, and is extinguished.

Also, at the lower side and upper side of the arc extinguishing space 145, magnetic flux inclines to the lower side and upper side with respect to the orientation of the magnetic flux between the contact portion 118*a* of the fixed contact 111 and the contact portion 130*a* of the movable contact 130. Because of this, the arc extended to the arc extinguishing space 145 is further extended by the inclined magnetic flux in the direction of the corner of the arc extinguishing space 145, it is possible to increase the arc length, and thus possible to obtain good interruption performance.

Meanwhile, the current I flows from the movable contact 130 side to the fixed contact 112 side between the contact portion 118*a* of the fixed contact 112 and the movable contact 130, and the orientation of the magnetic flux $\phi$ is in a rightward direction from the inner side toward the outer side, as shown in FIG. 6(*b*). Because of this, in accordance with Fleming's left-hand rule, a large Lorentz force F acts toward the arc extinguishing space 145, perpendicular to the longitudinal direction of the movable contact 130 and perpendicular to the switching direction of the contact portion 118*a* of the fixed contact 112 and the movable contact 130.

Due to the Lorentz force F, an arc generated between the contact portion 118*a* of the fixed contact 112 and the movable contact 130 is greatly extended so as to pass from the upper surface side of the movable contact 130 through the inside of the arc extinguishing space 145, reaching the side surface side of the fixed contact 112, and is extinguished.

Also, at the lower side and upper side of the arc extinguishing space 145, as heretofore described, magnetic flux inclines to the lower side and upper side with respect to the orientation of the magnetic flux between the contact portion 118*a* of the fixed contact 112 and the contact portion 130*a* of the movable contact 130. Because of this, the arc extended to the arc extinguishing space 145 is further extended by the inclined magnetic flux in the direction of the corner of the arc extinguishing space 145, it is possible to increase the arc length, and thus possible to obtain good interruption performance.

Meanwhile, in the engaged condition of the electromagnetic contactor 10, when adopting a released condition in a condition wherein a regenerative current flows from the load side to the direct current power source side, the direction of current in FIG. 6(*b*) described above is reversed, meaning that the Lorentz force F acts on the arc extinguishing space 146 side, and excepting that the arc is extended to the arc extinguishing space 146 side, the same arc extinguishing function is fulfilled.

At this time, as the arc extinguishing permanent magnets 143 and 144 are disposed in the magnet housing cylinders 141 and 142 formed in the insulating cylinder 140, the arc does not directly contact with the arc extinguishing permanent magnets 143 and 144. Because of this, it is possible to stably maintain the magnetic characteristics of the arc extinguishing permanent magnets 143 and 144, and thus possible to stabilize interruption performance.

Also, as it is possible to cover and insulate the inner peripheral surface of the metal tubular body 104 with the insulating cylinder 140, there is no short circuiting of the arc when the current is interrupted, and it is thus possible to reliably carry out current interruption.

Furthermore, as it is possible to carry out the insulating function, the function of positioning the arc extinguishing permanent magnets 143 and 144, the function of protecting the arc extinguishing permanent magnets 143 and 144 from the arc, and the insulating function preventing the arc from reaching the external metal tubular body 104 with the one insulating cylinder 140, it is possible to reduce manufacturing cost.

Also, as it is possible to increase the distance between the side edges of the movable contact 130 and the inner peripheral surface of the insulating cylinder 140 by the thickness of the arc extinguishing permanent magnets 143 and 144, it is possible to provide sufficient arc extinguishing spaces 145 and 146, and thus possible to reliably carry out arc extinguishing.

Furthermore, as the movable contact guide members 148 and 149 that slide against a side edge of the movable contact are formed protruding on the magnet housing cylinders 141 and 142 housing the arc extinguishing permanent magnets 143 and 144 in positions facing the movable contact 130, it is possible to reliably prevent turning of the movable contact 130.

Figure 8A:
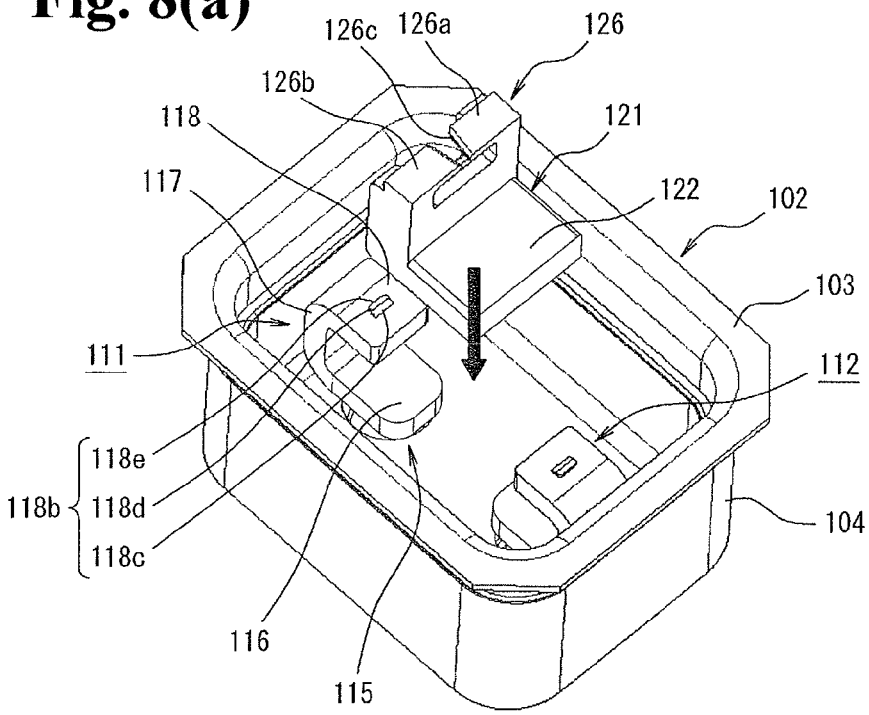
FIGS. 8(*a*) and 8(*b*) are diagrams showing another example of an insulating cover, wherein FIG. 8(*a*) is a perspective view showing a condition before mounting and FIG. 8(*b*) is a perspective view showing a condition after mounting.
Figure 8B:
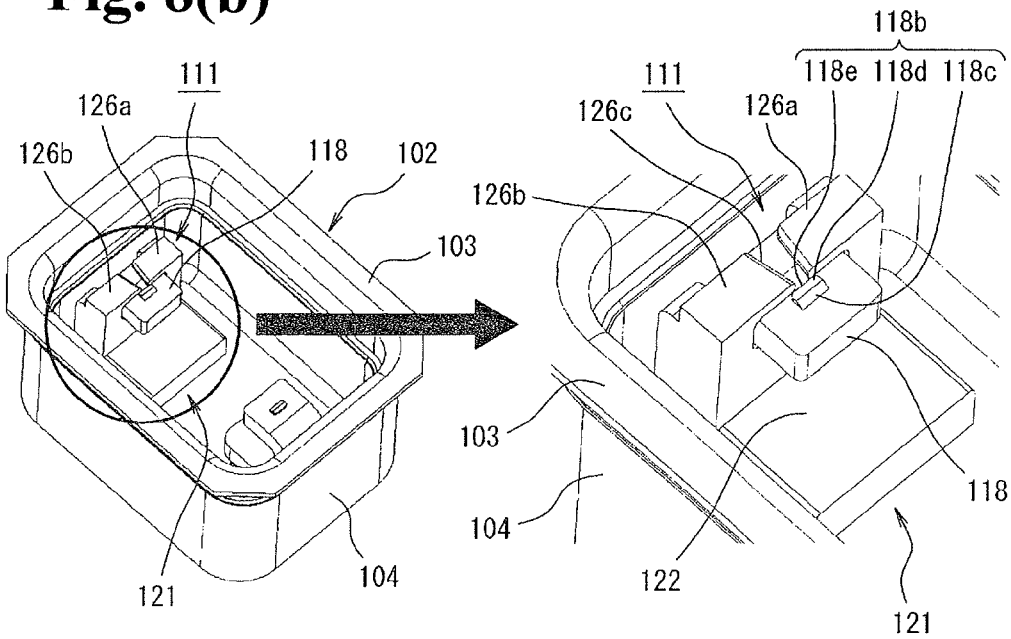

In the heretofore described embodiment, a description has been given of a case wherein the insulating cover 121 is attached to the fixed contacts 111 and 112 by the fitting portion 125 being fitted onto the small diameter portion 114*b* formed on the support conductor portion 114 of the fixed contacts 111 and 112. However; not being limited to this, a snap-fitting portion 126 that covers, the lower plate portion 118 of the C-shaped portion 115 of the fixed contacts 111 and 112 may be formed on the lower surface side of the L-shaped plate portion 122 of the insulating cover 121, as shown in FIGS. 8(*a*) and 8(*b*).

The snap-fitting portion 126 is engaged on a protrusion 118*b* formed on the lower surface of the lower plate portion 118 of the C-shaped portion 115 of the fixed contacts 111 and 112, thereby preventing falling out. That is, the snap-fitting portion 126 has a pair of L-shaped covering portions 126*a* and 126*b* that extend from an end surface side in the front-back direction of the L-shaped plate portion 122 so as to cover the lower plate portion 118. A tapered groove portion 126*c* that gradually widens the opposing distance from the inner side toward the outer side as seen in FIGS. 8(*a*) and 8(*b*) is formed in opposing lower end side faces of the covering portions 126*a* and 126*b*.

Meanwhile, the protrusion 118*b* formed on the lower plate portion 118 of the C-shaped portion 115 of the fixed contacts 111 and 112 is configured of an inclined surface 118*c* that becomes gradually higher from the inner side toward the outer side, a flat surface 118*d* that extends slightly outward from the lower end of the inclined surface 118*c*, parallel with the lower plate portion 118, and a locking surface 118*e* oriented from the outer side end surface of the flat surface 118*d* toward the lower surface of the lower plate portion 118.

Further, when the fitting portion 125 of the insulating cover 121 is fitted onto the small diameter portion 114*b* of the support conductor portion 114 of the fixed contacts 111 and 112, as previously described, the lower plate portion 118 of the C-shaped portion 115 of the fixed contacts 111 and 112 is inserted into the L-shaped covering portions 126*a* and 126*b*. By so doing, the tapered groove portion 126*c* between the covering portions 126*a* and 126*b* engages with the inclined surface 118*c* of the protrusion 118*b* and bows downward (upward in FIG. 8(*b*)), and subsequently, after engaging with the flat surface 118*d*, reaches the locking surface 118*e* on the outer side of the flat surface 118*d*, as shown in FIG. 8(*b*).

Because of this, the deforming of the covering portions 126*a* and 126*b* recovers, the inner end surfaces of the covering portions 126*a* and 126*b* are in contact with the locking surface 118*e* of the protrusion 118*b*, and movement of the insulating cover 121 to the inside is regulated. Consequently, the insulating cover 121 is accurately positioned by the snap-fitting portion 126 on the lower plate portion 118 having the contact portions 118*a* of the fixed contacts 111 and 112, and it is possible to reliably carry out contact with the movable contact 130 without the contact portions 118*a* being covered by one portion of the insulating cover 121.

Figure 9:
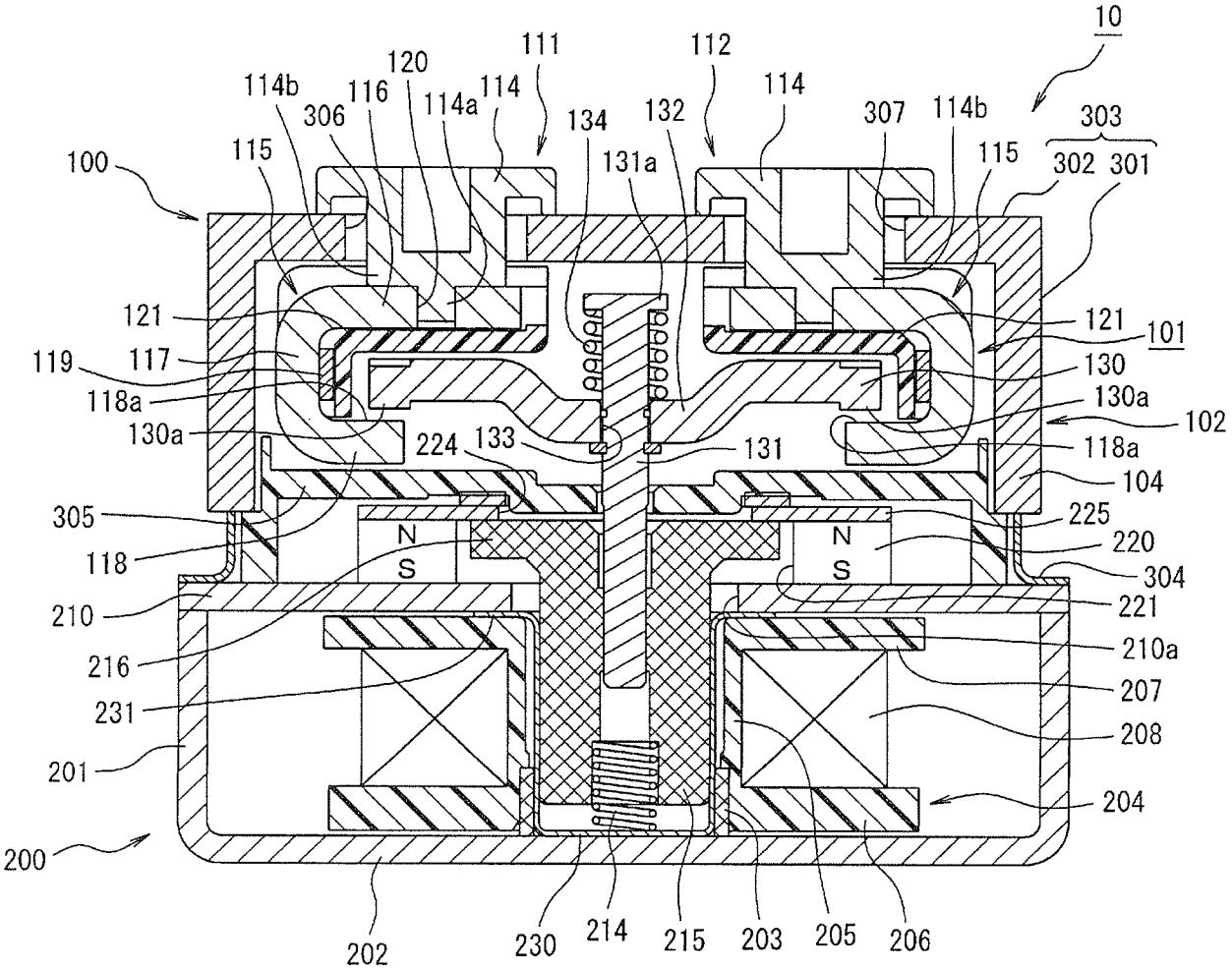
FIG. 9 is a sectional view showing another example of a contact device.

Also, in the heretofore described embodiment, a description has been given of a case wherein the contact housing case 102 of the contact device 100 is configured of the metal tubular body 104 and fixed contact support insulating substrate 105 but, not being limited to this, it is possible to adopt another configuration. For example, as shown in FIG. 9 and FIG. 2(*b*), the contact housing case 102 may be formed by a tubular portion 301 and an upper surface plate portion 302 closing off the upper end of the tubular portion 301 being formed integrally of a ceramic or a synthetic resin material, forming a tub-form body 303, a metal foil being formed on an opened end surface side of the tub-form body 303 by a metalizing process, and a metal connection member 304 being seal joined to the metal foil.

Also, in the heretofore described embodiment, a description has been given of a case wherein the opposing magnetic pole faces of the arc extinguishing permanent magnets 143 and 144 are N-poles but, not being limited to this, it is also possible to obtain the same advantages as in the heretofore described embodiment when arranging so that the opposing magnetic pole faces of the arc extinguishing permanent magnets 143 and 144 are S-poles, with the exception that the direction in which the magnetic flux crosses the arc and the direction of the Lorentz force are reversed.

Figure 10A:
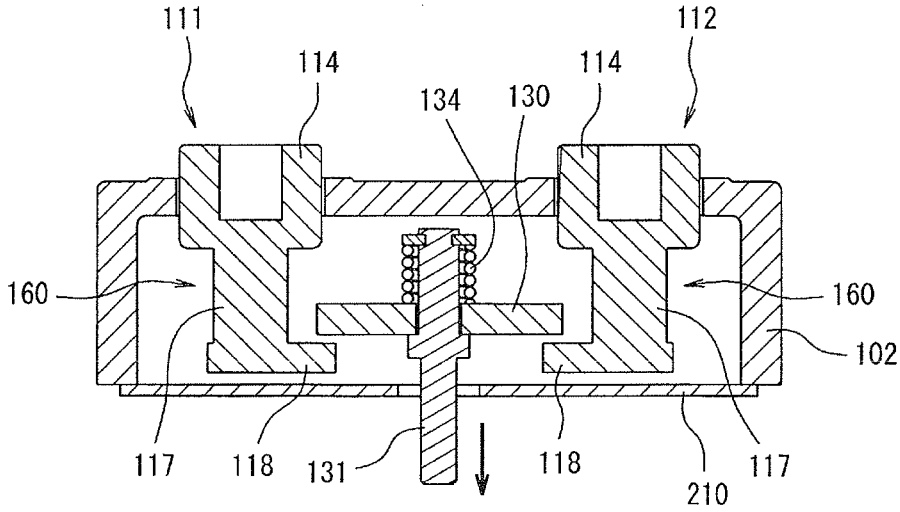
FIGS. 10(*a*) and 10(*b*) are diagrams showing another example of a contact mechanism, wherein FIG. 10(*a*) is a sectional view and FIG. 10(*b*) is a perspective view.
Figure 10B:
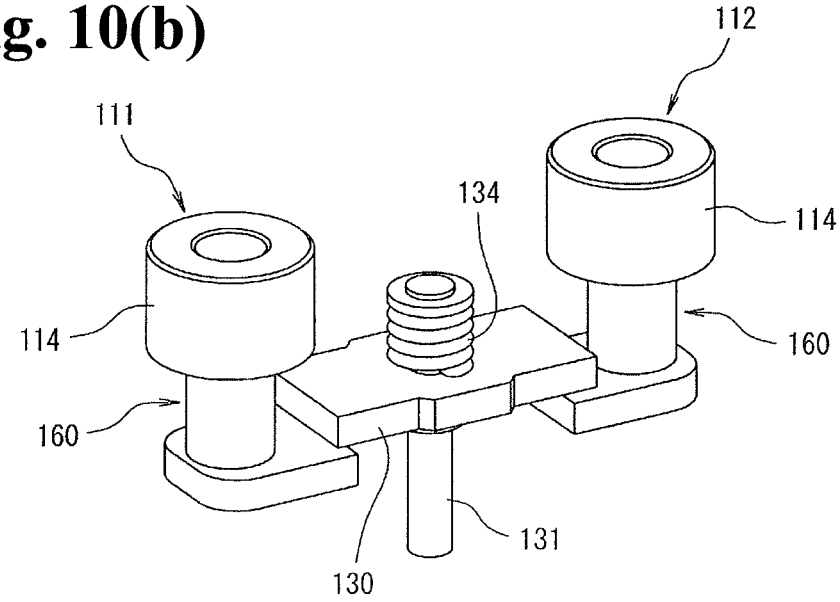

Also, in the heretofore described embodiment, a description has been given of a case wherein the C-shaped portion 115 is formed in the fixed contacts 111 and 112 but, not being limited to this, an L-shaped portion 160, of a form such that the upper plate portion 116 of the C-shaped portion 115 is omitted, may be connected to the support conductor portion 114, as shown in FIGS. 10(*a*) and 10(*b*). In this case, the insulating cover 121 is mounted so as to cover the lower surface of the support conductor portion 114 and the intermediate plate portion 117.

In this case too, in the closed contact condition wherein the movable contact 130 contacts with the fixed contacts 111 and 112, it is possible to cause magnetic flux generated by the current flowing through a vertical plate portion of the L-shaped portion 160 to act on portions in which the fixed contacts 111 and 112 and the movable contact 130 are in contact. Because of this, it is possible to increase the magnetic flux density in the portions in which the fixed contacts 111 and 112 and the movable contact 130 are in contact, generating a Lorentz force that opposes the electromagnetic repulsion force. Also, using the insulating cover 121, it is possible to reliably prevent the arc from moving above the fixed contacts, and also possible to reliably prevent the leading edge of the arc from short circuiting in a portion other than the contact portions of the fixed contacts.

Figure 11A:
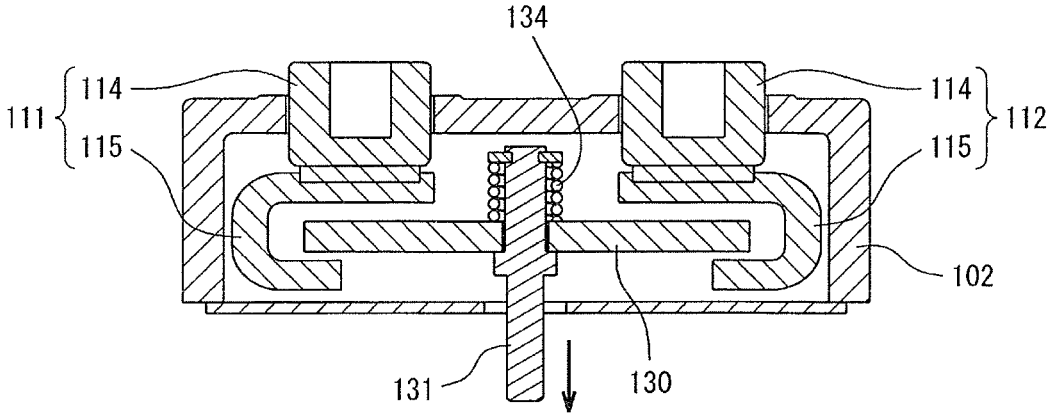
FIGS. 11(*a*) and 11(*b*) are diagrams showing another example of a movable contact of a contact mechanism, wherein FIG. 11(*a*) is a sectional view and FIG. 11(*b*) is a perspective view.
Figure 11B:
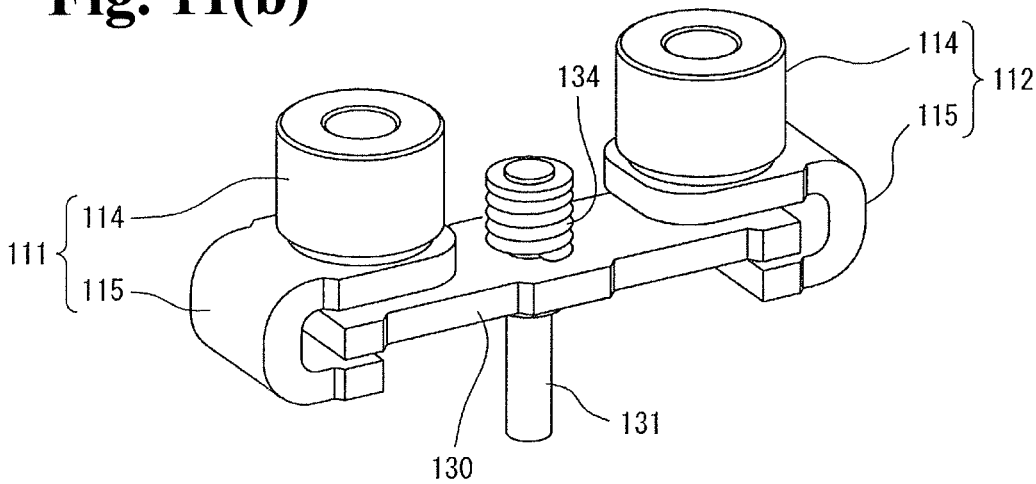

Also, in the heretofore described embodiment, a description has been given of a case wherein the movable contact 130 has the depressed portion 132 in a central portion thereof but, not being limited to this, the depressed portion 132 may be omitted, forming a flat plate, as shown in FIGS. 11(*a*) and 11(*b*).

Also, in the heretofore described embodiment a description has been given of a case wherein the connecting shaft 131 is screwed to the movable plunger 215, but the movable plunger 215 and connecting shaft 131 may also be formed integrally.

Also, a description has been given of a case wherein the connection of the connecting shaft 131 and movable contact 130 is such that the flange portion 131*a* is formed on the leading end portion of the connecting shaft 131, and the lower end of the movable contact 130 is fixed with a C-ring after the connecting shaft 131 is inserted into the contact spring 134 and movable contact 130, but this is not limiting. That is, a positioning large diameter portion may be formed protruding in a radial direction in the C-ring position of the connecting shaft 131, the contact spring 134 disposed after the movable contact 130 contacts with the large diameter portion, and the upper end of the contact spring 134 may be fixed with the C-ring.

Also, the configuration of the electromagnet unit 200 not being limited to the configuration of the heretofore described embodiment, it is possible to apply any configuration.

Also, in the heretofore described embodiment, a description has been given of a case wherein a hermetic receptacle is configured of the contact housing case 102 and cap 230, and gas is encapsulated inside the hermetic receptacle but, not being limited to this, the gas encapsulation may be omitted when the interrupted current is small.

INDUSTRIAL APPLICABILITY

According to the invention, it is possible to provide an electromagnetic contactor such that it is possible to regulate an arc generation position, thereby reliably carrying out arc extinguishing.

What is claimed is:

1. An electromagnetic contactor, comprising:

a contact device including a pair of fixed contacts disposed to maintain a predetermined distance, and a movable contact disposed to be capable of contacting to and separating from the pair of fixed contacts, magnetic plates, each having a C-shape mounted to cover an inner side surface of an intermediate plate portion of each of the pair of fixed contacts, and to shield a magnetic field generated by a current flowing through the intermediate plate portion of the each of the pair of fixed contacts, and insulating covers, each covering all except for a contact portion contacting the movable contact and mounted on the each of the pair of fixed contacts to regulate arc generation, wherein the insulating cover prevents an end portion of an arc from moving above the pair of fixed contacts when the arc is generated upon separation of the movable contact from the pair of fixed contacts, and prevents a leading edge of the extended arc from contacting the pair of fixed contacts.

2. An electromagnetic contactor according to claim 1, wherein the pair of fixed contacts includes:

support conductor portions supported to maintain a predetermined interval with an upper surface of a contact housing case, and C-shaped portions formed in a C-shape, each including an upper plate portion connected to an end portion of the support conductor portion inside the contact housing case, the intermediate plate portion, the intermediate plate portion extending downward from the upper plate portion at a side opposite to another support conductor portion, and a lower plate portion formed with the contact portion on an upper surface and extending from a lower end of the intermediate plate portion to a side of the another support conductor portion, wherein each of the insulating covers is configured to expose at least the contact portion of the C-shaped portion and to cover a surface facing the movable contact and side surfaces continuing from the surface facing the movable contact.

3. An electromagnetic contactor according to claim 2, wherein each of the insulating covers includes:

an L-shaped portion to cover an inner surface of the upper plate portion and the intermediate plate portion of the C-shaped portion of each of the pair of fixed contacts, side plate portions extending from side edges of the L-shaped portion to cover side surfaces of the C-shaped portion, and fitting portions extending inward from upper ends of the side plate portions facing the support conductor portion and fitting onto a small diameter portion formed on the support conductor portion.

4. An electromagnetic contactor according to claim 2, wherein each of the insulating covers includes:

an L-shaped portion to cover inner surfaces of the upper plate portion and intermediate plate portion of the C-shaped portion of each of the pair of fixed contacts, side plate portions extending from side edges of the L-shaped portion to cover side surfaces of the C-shaped portion, and a snap-fitting portion to engage with a protrusion formed on a lower surface of the lower plate portion of the C-shaped portion.

5. An electromagnetic contactor according to claim 3, further comprising arc extinguishing permanent magnets arranged along two sides of the contact device in a length direction of the contact device to extinguish the arc generated between the movable contact and the pair of fixed contacts.

6. An electromagnetic contactor according to claim 5, wherein the C-shaped magnetic plate is disposed between the insulating cover and the fixed contact, and arranged around side portions of the contact device.

7. An electromagnetic contactor according to claim 4, wherein the snap-fitting portion includes a pair of L-shaped covering portions extending from a portion covering the intermediate plate portion, and covering the lower plate portion.

8. An electromagnetic contactor, comprising:

a contact device including a pair of fixed contacts disposed to maintain a predetermined distance, the pair of fixed contacts each having a C-shaped portion including an upper plate portion, an intermediate plate portion extending downward from the upper plate portion, and a lower plate portion extending from a lower end of the intermediate plate portion, and a movable contact disposed to be capable of contacting to and separating from the pair of fixed contacts;

a pair of arc extinguishing permanent magnets each arranged along a side of the contact device in a length direction of the contact device and disposed to face each other to extinguish an arc generated between the movable contact and the pair of fixed contacts;

an insulating cover covering the pair of fixed contacts and exposing a contact portion of the pair of fixed contacts contacting the movable contact to regulate arc generation, the insulating cover including an L-shaped portion to cover an inner surface of the upper plate portion and the intermediate plate portion of the C-shaped portion of each of the pair of fixed contacts, and side plate portions extending from side edges of the L-shaped portion to cover side surfaces of the C-shaped portion of each of the pair of fixed contacts; and a pair of magnetic plates each disposed between the intermediate plate portion and the insulating cover, and having a C-shape mounted to cover an inner side surface of the intermediate plate portion of each of the fixed contacts to shield a magnetic field generated by a current flowing through the pair of fixed contacts, wherein the insulating cover prevents an end portion of the arc from moving above the pair of fixed contacts when the arc is generated upon separation of the movable contact from the pair of fixed contacts, and prevents a leading edge of the extended arc from contacting the pair of fixed contacts.

9. An electromagnetic contactor according to claim 8, wherein the pair of magnetic plates and the pair of arc extinguishing permanent magnets are disposed to form a space at four corners of the contact device.

10. An electromagnetic contactor according to claim 9, wherein the insulating cover includes a snap-fitting portion to engage with a protrusion formed on a lower surface of the lower plate portion of the C-shaped portion.

* * * * *

UNITED STATES PATENT AND TRADEMARK OFFICE

CERTIFICATE OF CORRECTION

PATENT NO. : 8,836,456 B2
APPLICATION NO. : 13/878945
DATED : September 16, 2014
INVENTOR(S) : Hiroyuki Tachikawa et al.

It is certified that error appears in the above-identified patent and that said Letters Patent is hereby corrected as shown below:

In the Specification

Change column 10, line 57, from "… opened Contact condition…" to --opened contact condition--.

Signed and Sealed this
Thirty-first Day of March, 2015

Michelle K. Lee

Michelle K. Lee
*Director of the United States Patent and Trademark Office*